United States Patent [19]

Schweim

[11] 4,125,965

[45] Nov. 21, 1978

[54] ALL PURPOSE FLOWER STAND

[76] Inventor: Walter C. G. Schweim, R.R. #3, Box 450, Mankato, Minn. 56001

[21] Appl. No.: 814,754

[22] Filed: Jul. 11, 1977

[51] Int. Cl.[2] ..... A47G 7/00

[52] U.S. Cl. ..... 47/39; 47/41 R; 47/81

[58] Field of Search ..... 47/79, 81, 83, 39, 40, 47/66, 41 R

[56] References Cited

U.S. PATENT DOCUMENTS

| | | | |
|---|---|---|---|
| 124,207 | 3/1872 | Hess | 47/81 |
| 820,168 | 5/1906 | Andrews | 47/79 |
| 1,421,327 | 6/1922 | Waters | 47/66 |
| 1,444,666 | 2/1923 | Davis | 47/41 R |
| 1,448,808 | 3/1923 | McGowan | 47/41.1 |
| 2,003,986 | 6/1935 | Witthuhn | 47/39 |
| 3,576,088 | 4/1971 | Arca | 47/81 |
| 3,879,889 | 4/1975 | Schmid | 47/81 X |
| 3,958,366 | 5/1976 | Meyers | 47/81 |
| 4,052,818 | 10/1977 | Hagerty | 47/81 |

FOREIGN PATENT DOCUMENTS

| | | | |
|---|---|---|---|
| 245,000 | 10/1946 | Switzerland | 47/81 |
| 4,743 of | 1894 | United Kingdom | 47/79 |

*Primary Examiner*—E. H. Eickholt
*Attorney, Agent, or Firm*—Howard I. Podell

[57] ABSTRACT

A flower stand employs a vertical post which can be supported at its lower end by a horizontal cruciform shaped base having downwardly curved tips at the free ends thereof. The upper end of the post is threaded. A vertical hollow container open at its top end has a downwardly and inwardly tapered bottom section with a vertical threaded bore engaged by the upper end of the post. A flat perforated disc is disposed in between the top open section of the container and the bottom section and is held in place by a vertical spacer extending upward from the top of the bore to the bottom of the disc at the center thereof. A hollow flexible tube used for filling can be attached to a nipple extending from the interior of the bottom section which serves as a water reservoir. A wick extends from the bottom section through the perforated disc into the top open container section.

2 Claims, 4 Drawing Figures

ALL PURPOSE FLOWER STAND

SUMMARY OF THE INVENTION

This invention is directed toward a new type of flower stand using a container for flowers. The stand employs a vertical post which can be used indoors or outdoors either embedded in concrete, inserted in the ground or supported at its bottom end by a cruciform base.

A vertical hollow container open at the top is provided with a downwardly and inwardly extending bottom section. This section has a vertical threaded bore which threadedly engages the threaded top end section of the post.

A horizontal perforated disc is disposed in the container between the open top end and the top of the bottom section.

Plants, flowers or the like can be disposed in the container on top of the disc. The bottom section can be hollow with top and side openings, the side opening having a removable drain plug. The space between the disc and the plug can be filled with water whereby a water reservoir is formed to keep flowers and plants properly moist.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
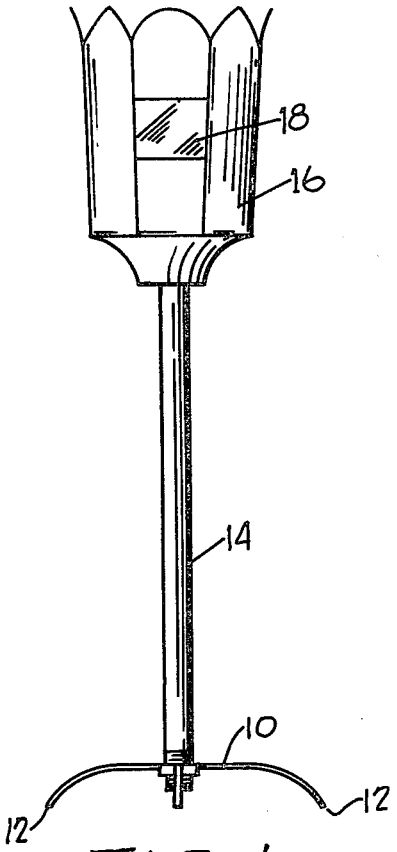
FIG. 1 is a side view of the invention.
Figure 2:
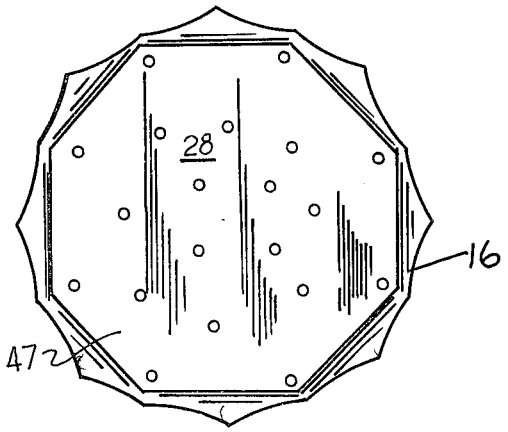
FIG. 2 is a top view thereof.
Figure 3:
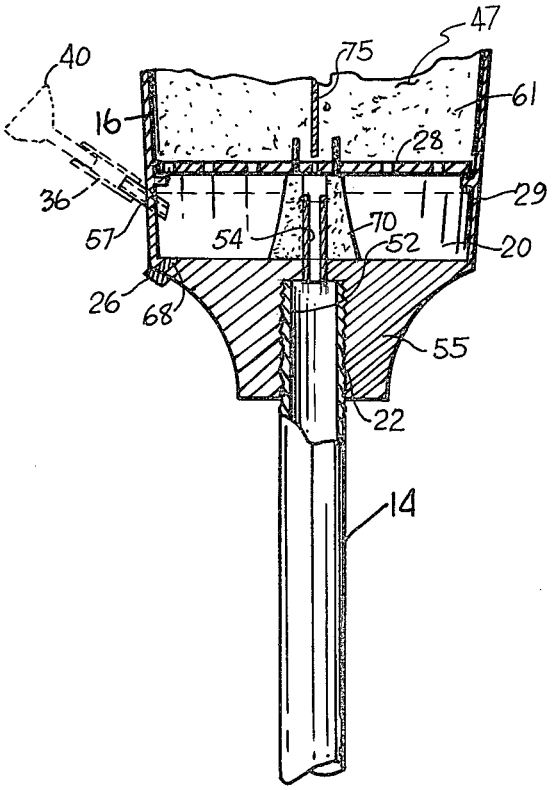
FIG. 3 is a side view in cross section of the structure FIG. 1.
Figure 4:
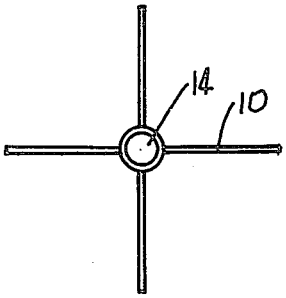
FIG. 4 is a bottom view of the structure of FIG. 1.

Turning now descriptively to the drawings, in which similar reference characters denote similar elements throughout the several views, referring now to FIGS. 1–4, a cruciform shaped horizontal base 10 with downwardly curved tips 12 at free ends is secured by bolts or other means at its center to the bottom end of vertical hollow post 14.

A vertical hollow container 16 open at its top end and shaped and sized as desired has a space 18 on the outside for a name plate or the like. The container has a hollow chamber section 20 located below the open chamber 47 of container 16 which extends downward and inward with a vertical threaded bore 22 extending from the base 55 of bottom section 20 threadedly engaging the top threaded end 52 of the post. Section 20 is covered by top plate 28 which rests on internal lugs 29 of the container wall.

A drain opening 68 having a removable drain plug 26 is located in base 55.

Chamber section 20 can be filled with water for use as indicated through a flexible tube 36 extending outwardly of the container 16, attached to nipple 57 joined to chamber section 20. Tube 36 is filled through a funnel 40.

Excess water in chamber section 20 overflows into tube 54, joined to the top of tube 14 and extending short of plate 28.

In use, plants are placed in soil 61 in open top chamber 47 and water filled through tube 36 into bottom chamber section 20, with the water being drawn into the soil in which the plants are potted, by means of wick 70 mounted about tube 54, with wick 70 extending through perforations of plate 28, into top chamber 47. An auxiliary wick 75 may be vertically mounted in the soil 61 of chamber 47.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A flower stand comprising a vertical hollow post having a top threaded end and mounted on a base at its opposed bottom end, a hollow open container threadably mounted to said top threaded end of said post, said container fitted with a bottom enclosed first chamber separated from a second chamber open to the top of the container by a perforated plate, said enclosed first chamber fitted with tubular means to add water to the said enclosed first chamber and with drain means to drain the chamber as desired, in which the open top end of a hollow tube extends to the upper section of the enclosed first chamber and is spaced a distance from the perforated plate, so as to serve as an overflow drain, with the interior of said tube joined to the interior of the post, and with a first wick mounted in the first enclosed chamber about said hollow tube and of a length so as to extend through perforations in the plate to the second chamber.

2. The combination as recited in claim 1 together with a second wick which is supported in soil in said second chamber, in use, at a spaced distance from said first wick.

* * * * *